US008881669B2

(12) United States Patent
Horvath

(10) Patent No.: US 8,881,669 B2
(45) Date of Patent: Nov. 11, 2014

(54) WRAP PREVENTING FLAG APPARATUS

(76) Inventor: Louis Horvath, Rochester Hills, MI (US)

( * ) Notice: Subject to any disclaimer, the term of this patent is extended or adjusted under 35 U.S.C. 154(b) by 162 days.

(21) Appl. No.: 13/382,178

(22) PCT Filed: Dec. 3, 2009

(86) PCT No.: PCT/US2009/066497

§ 371 (c)(1),
(2), (4) Date: Jan. 4, 2012

(87) PCT Pub. No.: WO2011/008224

PCT Pub. Date: Jan. 20, 2011

(65) Prior Publication Data

US 2012/0103246 A1 May 3, 2012

Related U.S. Application Data

(60) Provisional application No. 61/225,706, filed on Jul. 15, 2009.

(51) Int. Cl.
*G09F 17/00* (2006.01)

(52) U.S. Cl.
CPC ..... *G09F 17/00* (2013.01); *G09F 2017/008* (2013.01)
USPC ..... 116/174

(58) Field of Classification Search
CPC ..... G09F 17/00
USPC ..... 116/174, 173, 175
See application file for complete search history.

(56) References Cited

U.S. PATENT DOCUMENTS

| | | | | |
|---|---|---|---|---|
| 632,580 | A | 9/1899 | Macartney | |
| 975,114 | A | 11/1910 | Blank | |
| 1,277,347 | A | 9/1918 | Allen | |
| 1,646,467 | A | 10/1927 | Walton | |
| 2,225,103 | A | 12/1940 | Einermann | |
| 3,599,599 | A * | 8/1971 | Jones | 116/173 |
| 4,603,652 | A | 8/1986 | Thibault et al. | |
| 6,293,221 | B1 | 9/2001 | Kinahan | |
| 6,758,159 | B2 | 7/2004 | McCudden et al. | |
| 6,923,141 | B1 | 8/2005 | Staats et al. | |
| 7,017,512 | B2 | 3/2006 | Laird et al. | |
| 2005/0199176 | A1 | 9/2005 | Orton et al. | |

* cited by examiner

*Primary Examiner* — Daniel S Larkin
*Assistant Examiner* — Irving A Campbell
(74) *Attorney, Agent, or Firm* — Dickinson Wright PLLC

(57) ABSTRACT

A wrap preventing flag (44) apparatus including a rod (58) extending from the upper portion (22) of a flagpole (20) in a gravity plane (P) with an attachment (60, 62) securing the top edge (46) of a flag (44) to the rod (58). A rod support (84) inter-connects the rod (58) and the upper portion (22) of the flagpole (20) for preventing the rod (58) from rotating about the pole axis (A) while allowing free rotation of the rod (58) under the force of gravity only in the gravity plane (P). The rod support (84) includes a pair of stops (94) for limiting rotation of the rod (58) in or parallel to the gravity plane (P). In the first embodiment, the rod support (84) extends into an especially fabricated flagpole (20) whereas the rod support (84) of the second embodiment includes a first bracket (96) which is disposed about an existing flagpole (20) for securing the rod support (84) to the flagpole (20).

5 Claims, 9 Drawing Sheets

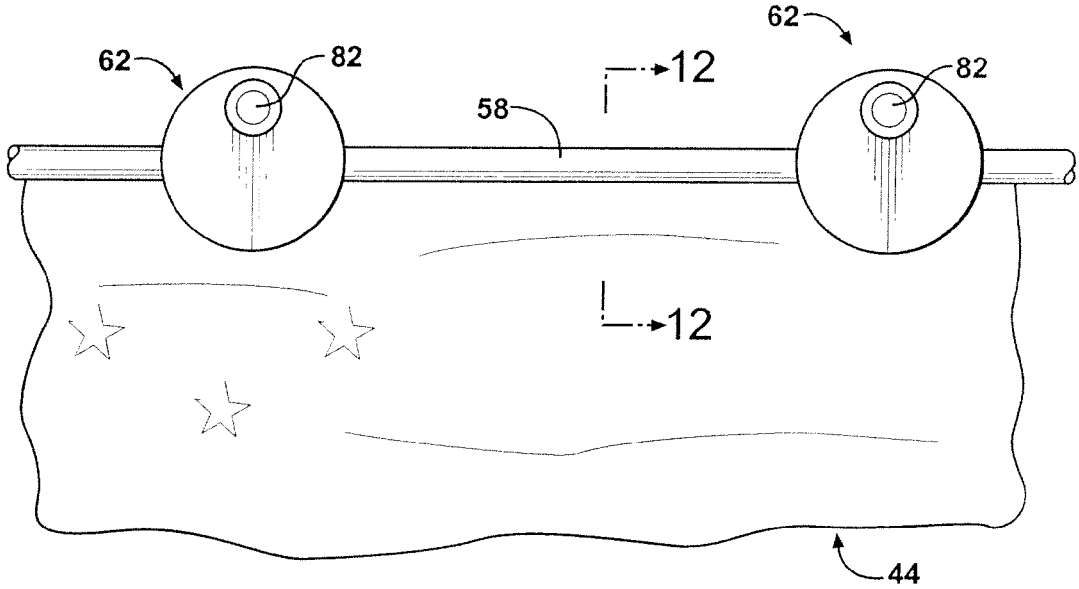
FIG. 11
FIG. 12
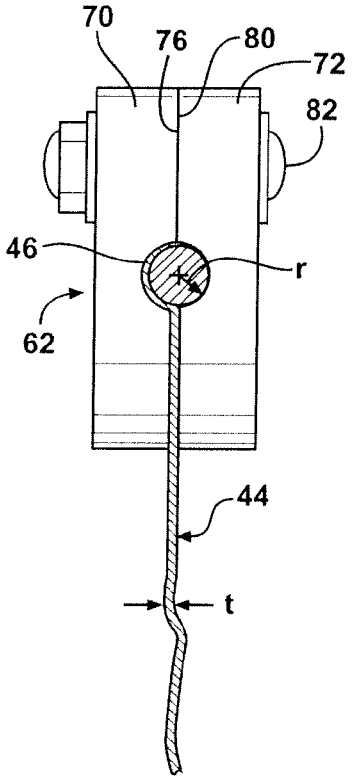
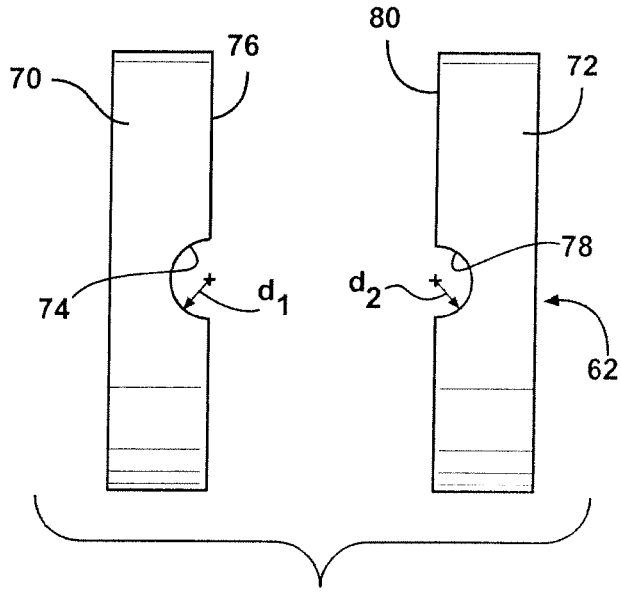
FIG. 13

WRAP PREVENTING FLAG APPARATUS

CROSS REFERENCE TO RELATED APPLICATION

This application claims the benefit of provisional application Ser. No. 61/225,706 filed Jul. 15, 2009.

BACKGROUND OF THE INVENTION

1. Field of the Invention

A wrap preventing flag apparatus useful for supporting a flag on a flagpole in an unfurled state, namely, for preventing the flag from wrapping around the flagpole or other nearby object.

2. Description of the Prior Art

The wrap preventing flag apparatus of the type to which the subject invention pertains, supports a flag on a rod extending from the upper portion of the flagpole for preventing the flag from becoming entangled on the flagpole or similar support structure. One such wrap preventing flag apparatus is illustrated in U.S. Pat. No. 632,580 to Macartney wherein a semi-rigid rod extends radially from the upper portion of the flagpole and into a sleeve in the top edge of the flag for preventing the flag from wrapping about the flagpole. This patent and the U.S. Pat. No. 4,603,652 to Thibault et al. disclose a rod mounted to a flagpole to permit rotation about the pole axis, thus permitting the flag to rotate freely about the pole axis as well. By allowing the flag to rotate freely about the pole axis, the prior art assemblies fail to prevent the remainder of the flag from becoming entangled on the pole, especially in wet conditions.

SUMMARY OF THE INVENTION AND ADVANTAGES

The invention provides such a wrap preventing flag apparatus including a rod support interconnecting the rod and the upper portion of the pole for preventing the rod from rotating about the pole axis and for allowing free rotation of the rod under the force of gravity only in the gravity plane.

The invention also provides a method of fabricating such a wrap preventing flag apparatus characterized by the steps of interconnecting the rod and the upper portion of the pole for preventing the rod from rotating about the pole axis and for allowing free rotation of the rod under the force of gravity only in the gravity plane.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 11 is a fragmentary side view of the clamps disposed about the rod and the flag;

FIG. 12 is a enlarged view taken along line 12 of FIG. 11;

FIG. 13 is an exploded view of two of the legs of the clamp.

DETAILED DESCRIPTION OF THE INVENTION

Figure 6:
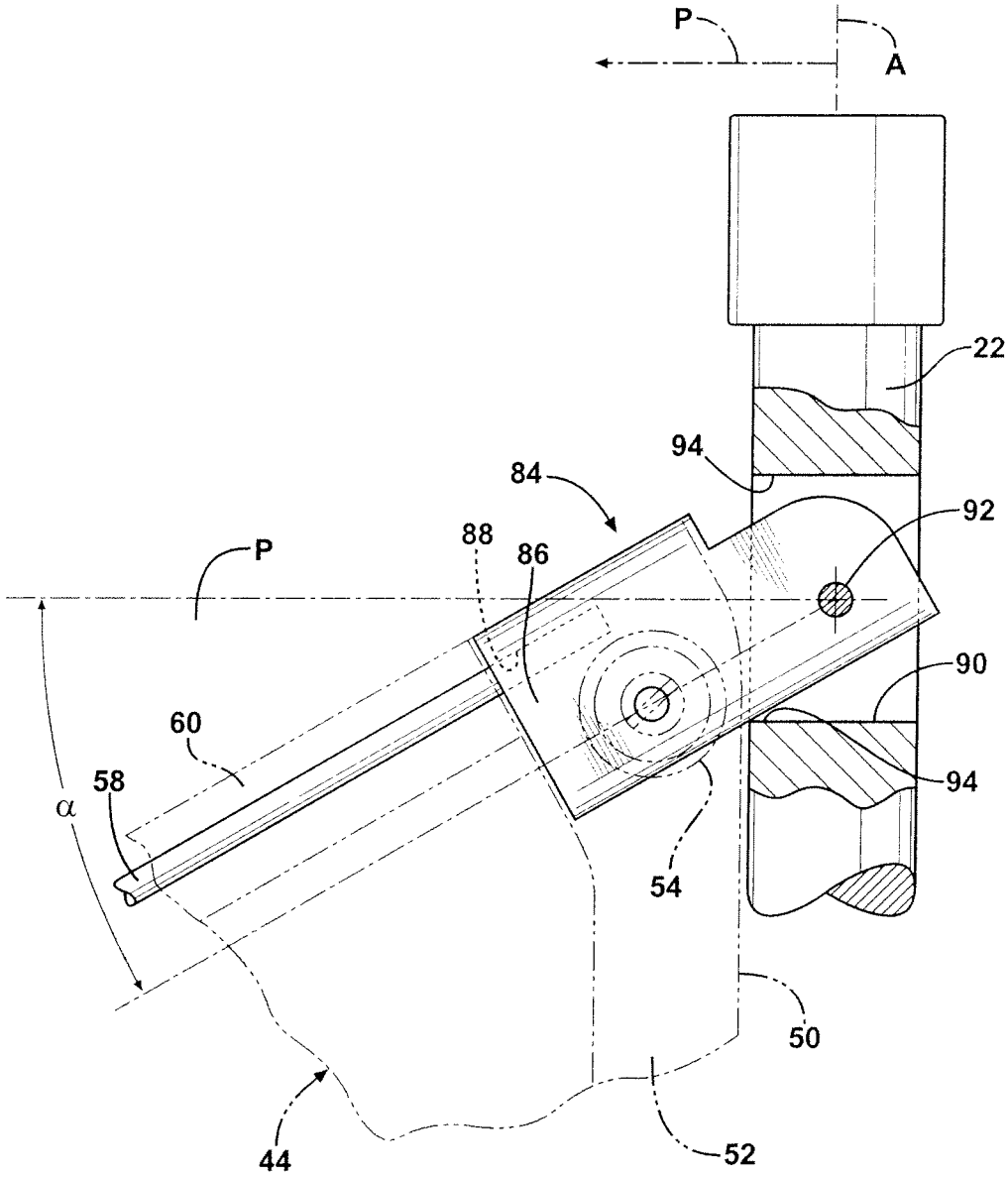
FIG. 6 is a fragmentary side view of the rod support and rod rotated to thirty degrees from the perpendicular toward the lower portion of the pole.
Figure 7:
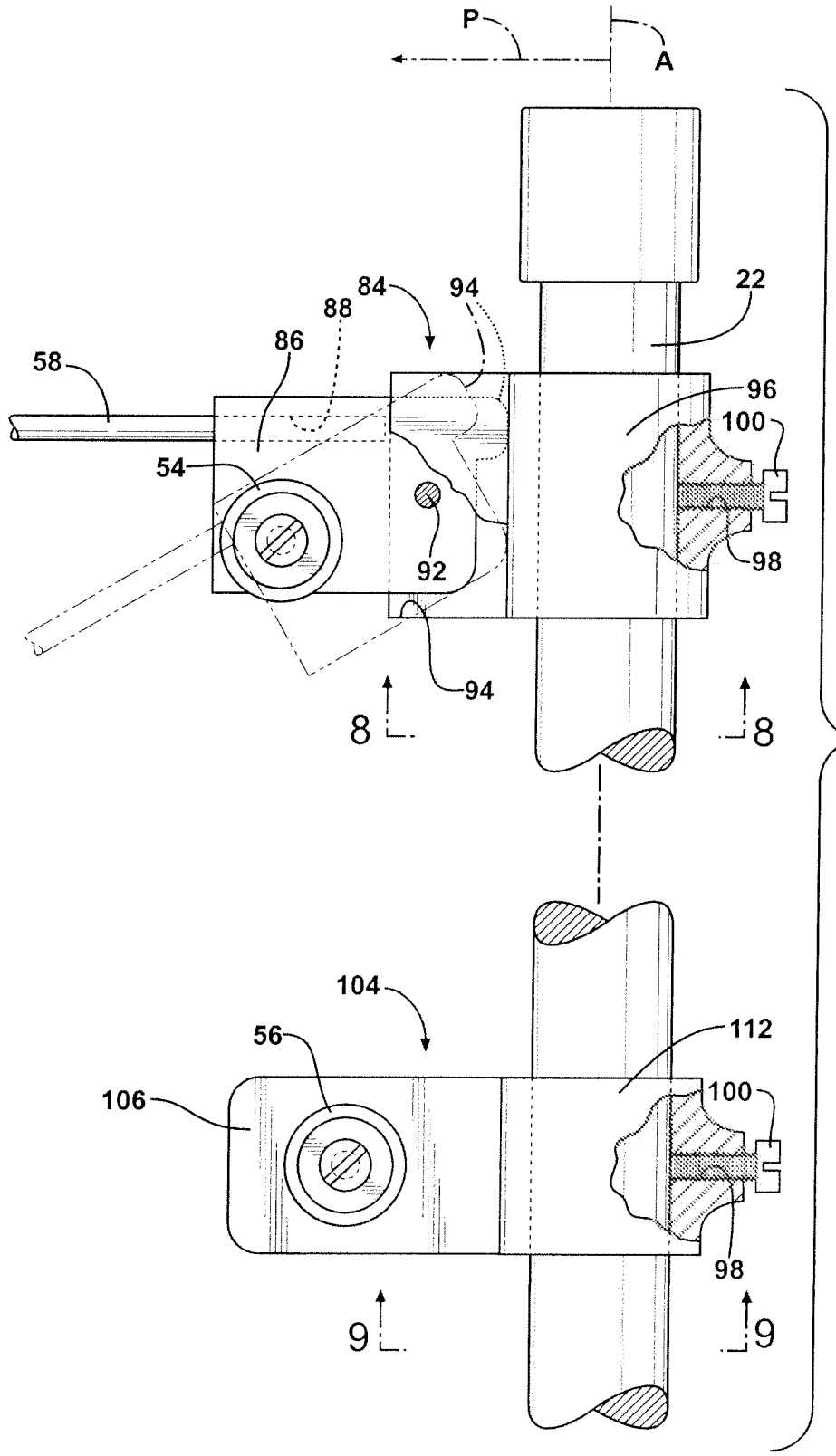
FIG. 7 is a fragmentary side view of the rod support and connector according to the second embodiment.
Figure 8:
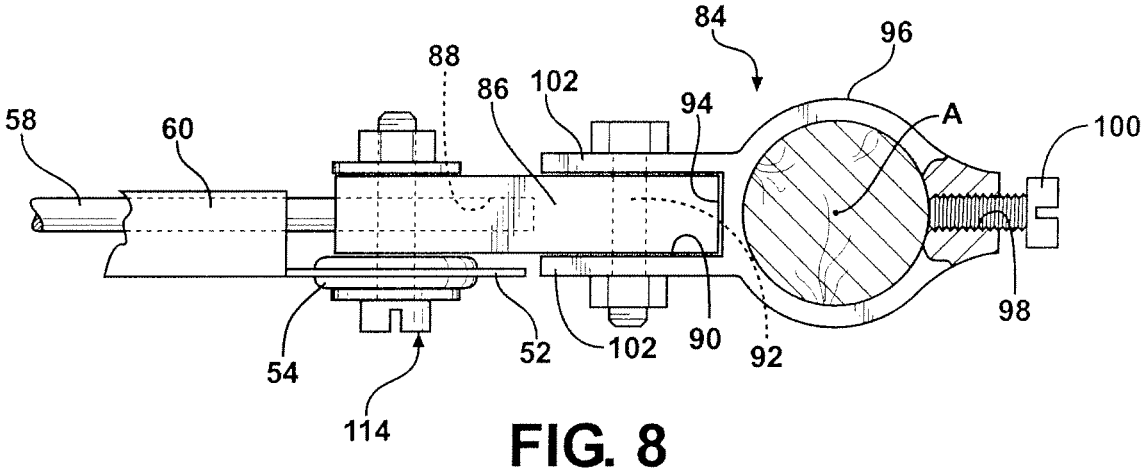
FIG. 8 is a cross-section view taken along line 8 of FIG. 7.
Figure 9:
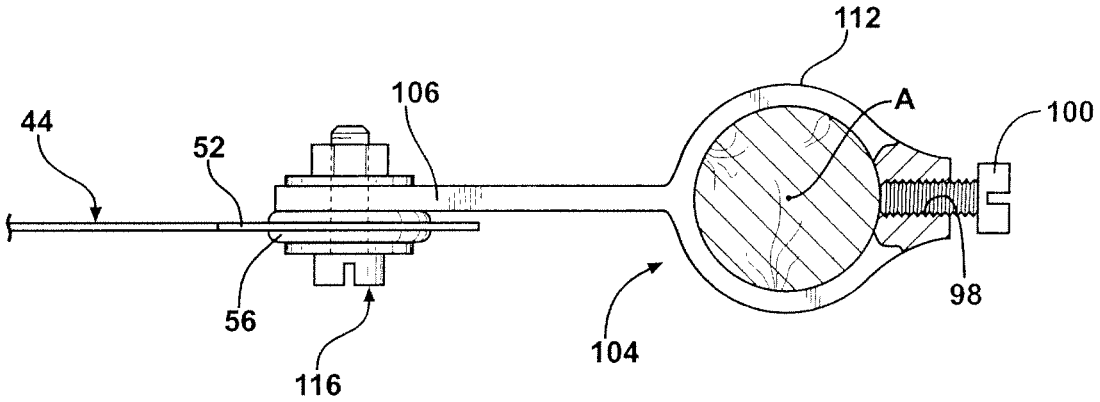
FIG. 9 is a cross-section view taken along line 9 of FIG. 7.

Referring to the Figures, wherein like numerals indicate corresponding parts throughout the several views, with a first embodiment of the wrap preventing apparatus constructed in accordance with the subject invention being shown in FIGS. 2-6 and 10, and a second embodiment being shown in FIGS. 7-9.

The wrap preventing apparatus includes an elongated flagpole 20, generally indicated, which extends along a pole axis A and has an upper portion 22 and a lower portion 24 bisected by a gravity plane P. The flagpole 20 could be solid as shown or tubular, i.e., a hollow tube. The gravity plane P extends through or parallel to the axis A, i.e., the center of the flagpole 20, toward the surface of the earth, e.g., vertically downward when mounted at an angle, as shown in FIG. 2.

A pole support 26, generally indicated, includes a base 28 or plate and a tube 30 extending from the base 28 at a forty-five degree angle for receiving the lower portion 24 of the flagpole 20 and retains the flagpole 20 in the pole support 26. The base 28 includes apertures 32 for attachment to a support structure by bolts, or the like.

Figure 1:
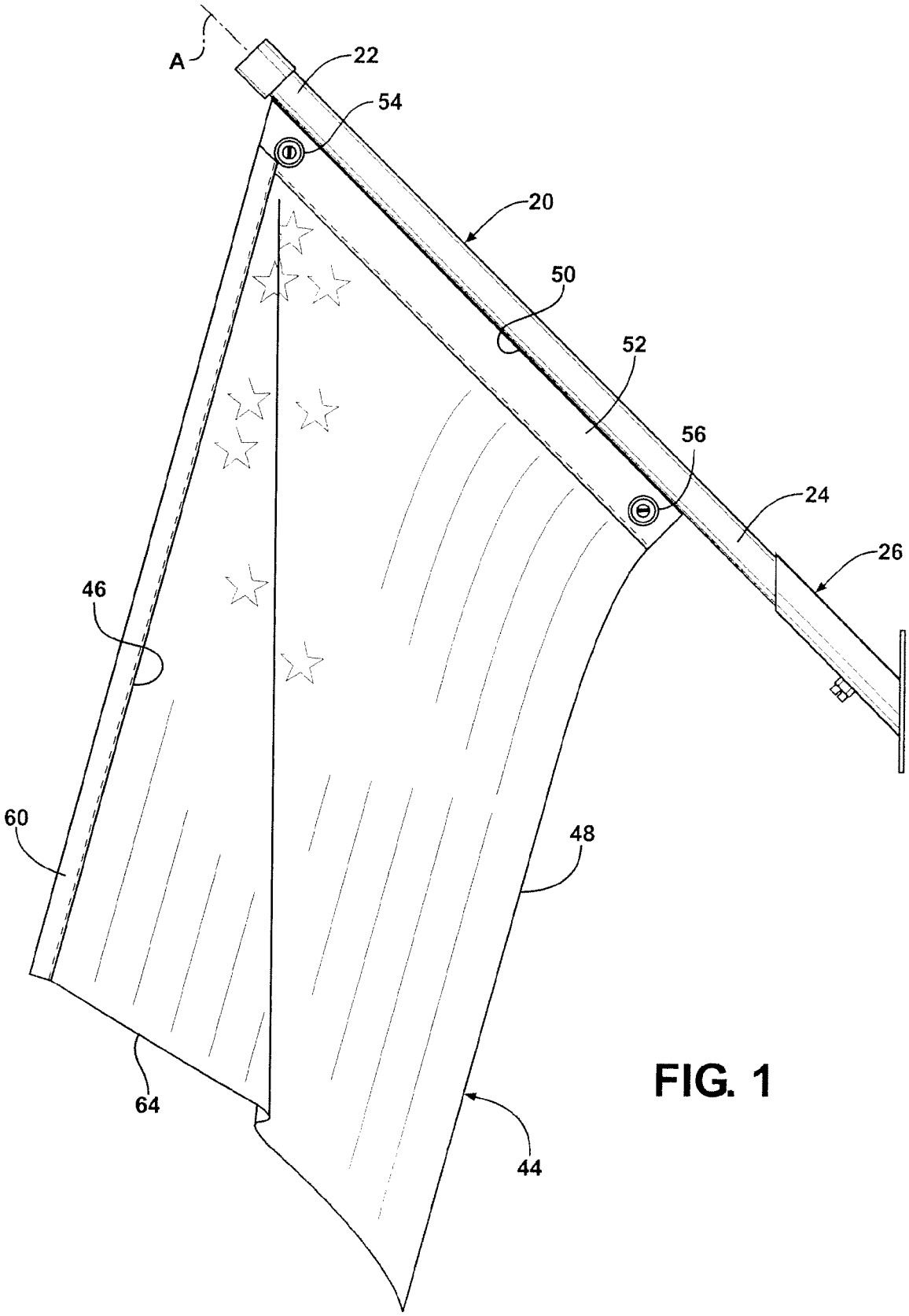
FIG. 1 is a side elevation view showing the wrap preventing flag apparatus of the subject invention.
Figures 2, 3:
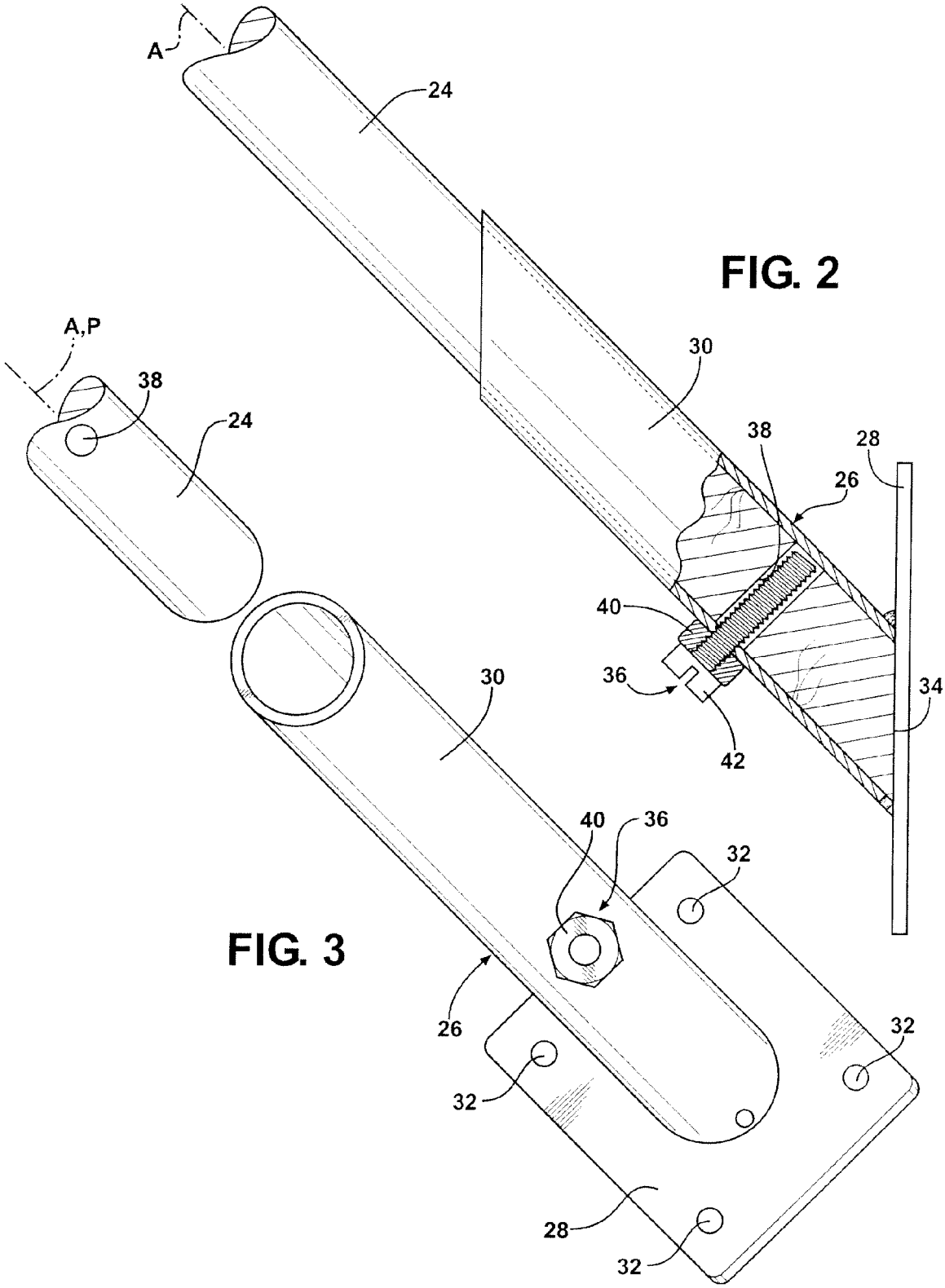
FIG. 2 is a fragmentary side view of the bolt engaging the tube of the pole support.
FIG. 3 is a fragmentary front view of the hole disposed in the lower portion of the pole and the pole support.
Figure 4:
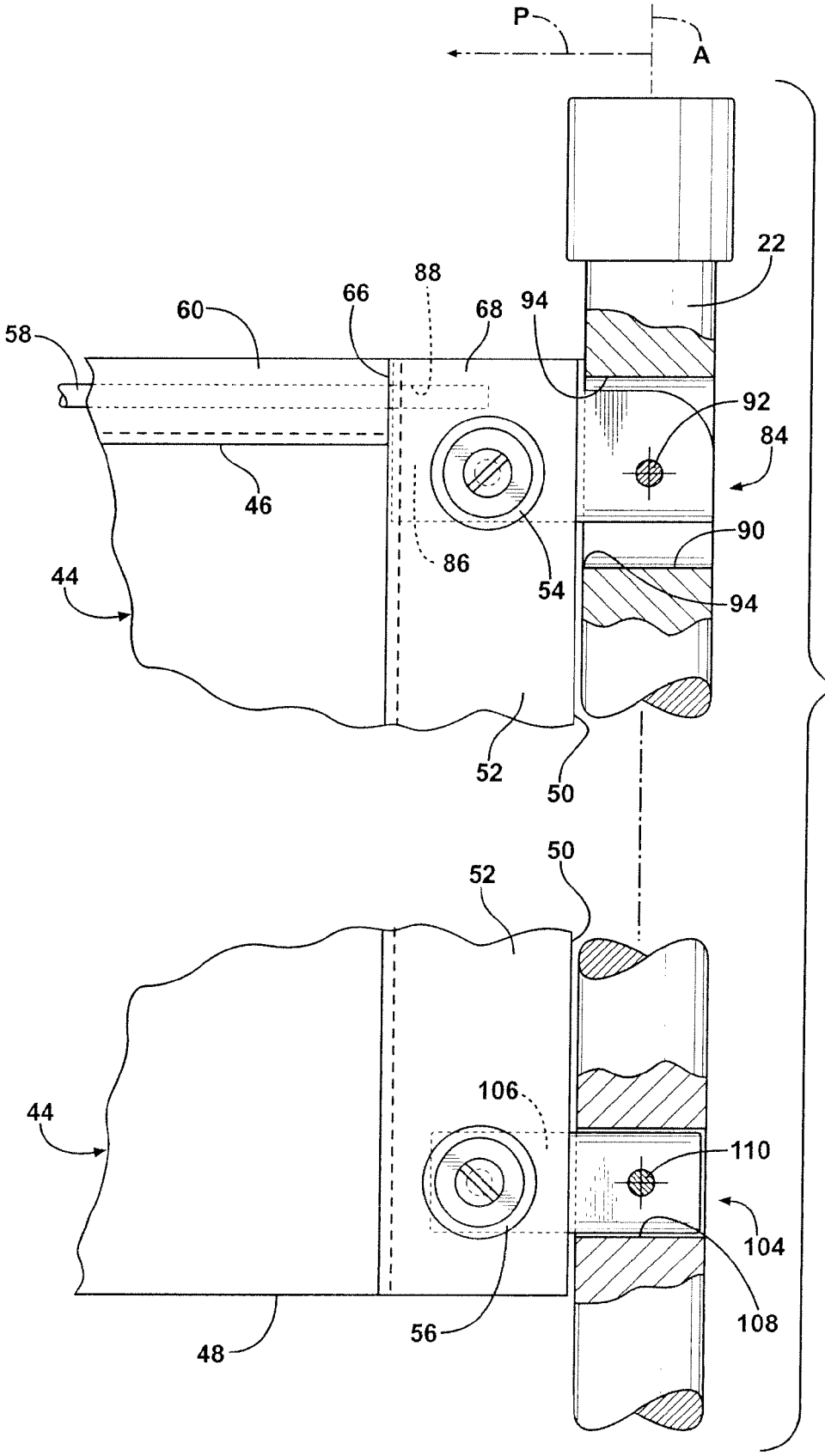
FIG. 4 is a fragmentary side view of the wrap preventing flag apparatus of the subject invention.
Figure 5:
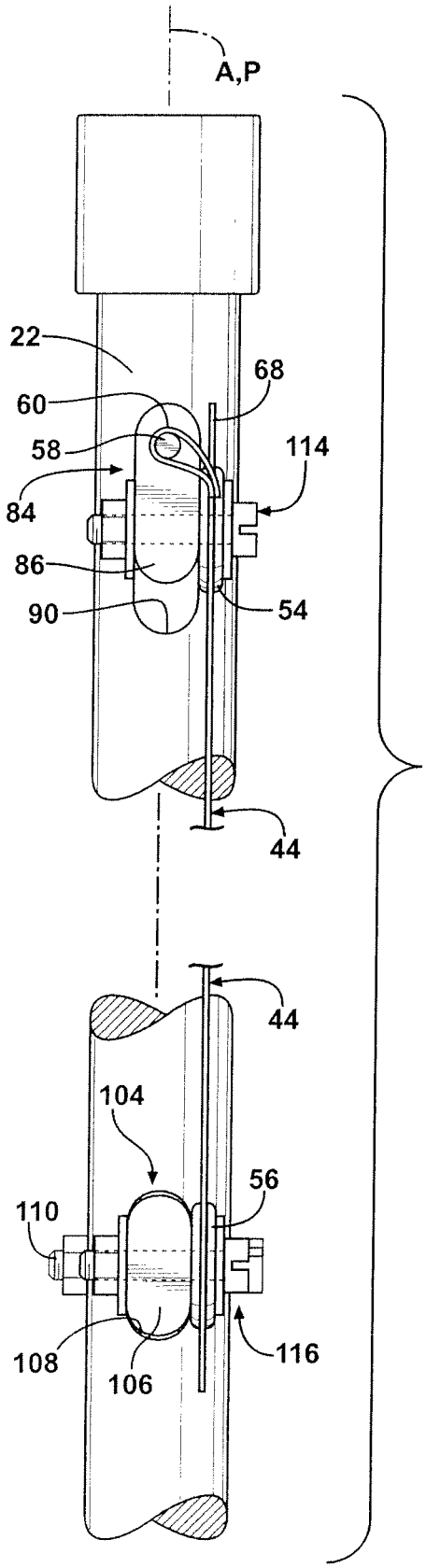
FIG. 5 is a fragmentary front view of the wrap preventing flag apparatus of the subject invention.

As shown in FIG. 2, the lower portion 24 of the flagpole 20 also includes a lower portion end 34 angled at forty-five degrees. A pole retainer 36, generally indicated, defines a hole 38 in the lower portion 24 of the flagpole 20 which is bisected by the gravity plane P. The pole retainer 36 also includes a nut 40 secured to the tube 30 and aligned with the hole 38, and a threaded bolt 42 threadedly engaging the nut 40 and extends through the tube 30 of the pole support 26 and into the hole 38 in the lower portion 24 of the flagpole 20 for retaining the flagpole 20 in the pole support 26 and for preventing the flagpole 20 from rotating about the pole axis A within the pole support 26.

A flexible banner, in the form of a flag 44, generally indicated, is rectangular in shape defined by a top edge 46 and a bottom edge 48 and a heading edge 50. The flag 44 has a heading 52 extending along the inner heading edge 50 of the flag 44. A top end grommet 54 is disposed in the heading 52 adjacent to the top edge 46, and a bottom end grommet 56 is disposed in the heading 52 adjacent to the bottom edge 48.

A rod 58 extends from the upper portion 22 of the flagpole 20 in or parallel to the gravity plane P. The rod 58 is formed from a non-rigid, i.e., flexible, material that is not flexible enough to wrap around the flagpole 20, such as fiberglass or spring steel, and has a circular cross-section with a radius r.

The flag 44 is attached to the rod 58 by at least one attachment 60, 62, which may include a sleeve 60, or a clamp 62, or the equivalent. The sleeve 60 extends along the top edge 46 of the flag 44 to a distal end 64 of the top edge 46 of the flag 44 and the rod 58 extends from the upper portion 22 of the flagpole 20 and into the sleeve 60. The sleeve 60 is closed at the distal end 64 and includes reinforced stitching for engaging the rod 58 and for preventing the flag 44 from sliding along the rod 58 toward the pole 20. The sleeve 60 ends at the heading 52 and does not extend through the heading 52. There is a slit 66 between the sleeve 60 and the top of the heading 68. Alternatively, the clamp 62 or clamps 62, generally indicated, are disposed about the rod 58 and the top edge 46 of the flag 44 for attaching the flag 44 to the rod 58. The clamps 62 include a first leg 70 and a second leg 72. The first leg 70 defines a first channel 74 or groove disposed in a first inner wall 76 and the second leg 72 defines a second channel 78 or groove disposed in a second inner wall 80. The first channel 74 has a depth $d_1$ or radius that is equal to the sum of a flag thickness t and the radius r of the rod 58. The second channel 78 has a depth $d_2$ or radius that is equal to the radius r of the rod 58. A clamp fastener 82 extends through the first and second legs 70, 72 for attaching the clamp 62 to the rod 58 by clamping the flag 44 to the rod 58.

Both embodiments include a rod support 84, generally indicated, interconnecting the rod 58 and the upper portion 22 of the flagpole 20 and includes a rod coupler 86 defining a bore 88 therein which is in or parallel to the gravity plane P which receives the rod 58. An adhesive (a film too thin to be depicted in the scale of the drawings) secures the rod 58 in the bore 88 of the rod coupler 86. The rod support 84 defines an upper elongated slot 90 bisected by the gravity plane P and includes a rotation connection 92 including a shaft 92 extending through and supported in the upper elongated slot 90 rotatably supporting the rod coupler 86 in the upper elongated slot 90. The rotation connection 92 could include any mechanical connection that facilitates rotation of the rod coupler 86 about an axis. The rod support 84 permits or allows free rotation of the rod 58 under the force of gravity in or parallel to the gravity plane P while preventing the rod 58 from rotating about the pole axis A.

The rod support 84 permits free rotation due to lack of friction, thus, the wind, weight of the flag 44, etc., are capable of causing the rod 58 to freely move in or parallel to the gravity plane P. The rod support 84 includes a pair of stops 94 for limiting rotation of the rod 58 in or parallel to the gravity plane P between predetermined positions, or angles, e.g., perpendicular to the pole axis A and an angle $\alpha$ of thirty degrees from the perpendicular toward the pole axis A. The rod coupler 86 engages the upper elongated slot 90 to establish the stops 94. The upper elongated slot 90 includes walls and various devices may be used as stops 94 to limit rotation of the rod coupler 86. Thus, when the wind blows at full force, the rod 58 is generally perpendicular to the pole axis A and when there is no wind present, the rod 58 is generally at an angle $\alpha$ of thirty degrees from the perpendicular toward the pole axis A. This angle $\alpha$ cannot exceed an angle which would permit enough slack in the remainder of the flag 44 to wrap around the pole 20 or to entangle on the pole 20, gutter, flora, or other nearby object. This angle may vary from thirty degrees depending on the mounting axis of the pole support 26 so long as it is limited to prevent flag 44 wrapping. As shown in FIG. 6, the thirty degree a angle is in or parallel to the gravity plane P.

In the first embodiment, the upper elongated slot 90 is disposed or formed in the upper portion 22 of the flagpole 20. In the second or retrofit embodiment, the rod support 84 includes a first bracket 96 disposed about an existing flagpole 20 (whether solid or tubular) for securing the rod support 84 to the flagpole 20 in a fixed position. The first bracket 96 is fastened to the flagpole 20 by a threaded bore 98 receiving a tightening bolt 100. Alternatively, the first bracket 96 could be fastened to the flagpole 20 by a threaded nut secured to the first bracket 96 for receiving a threaded screw. Two upper flanges 102 extend radially from the first bracket 96 and define the upper elongated slot 90 in the gravity plane P.

Both embodiments include a connector 104, generally indicated, which is supported by and extends from the flagpole 20 and is fixed medially between the upper portion 22 and the lower portion 24 of the flagpole 20 for retaining lower heading edge 50 of the flag 44 to the flagpole 20. The connector 104 includes a connector flange 106 that extends radially in the gravity plane P from the connector 104 and retains the flag 44 to the connector 104.

Figure 10:
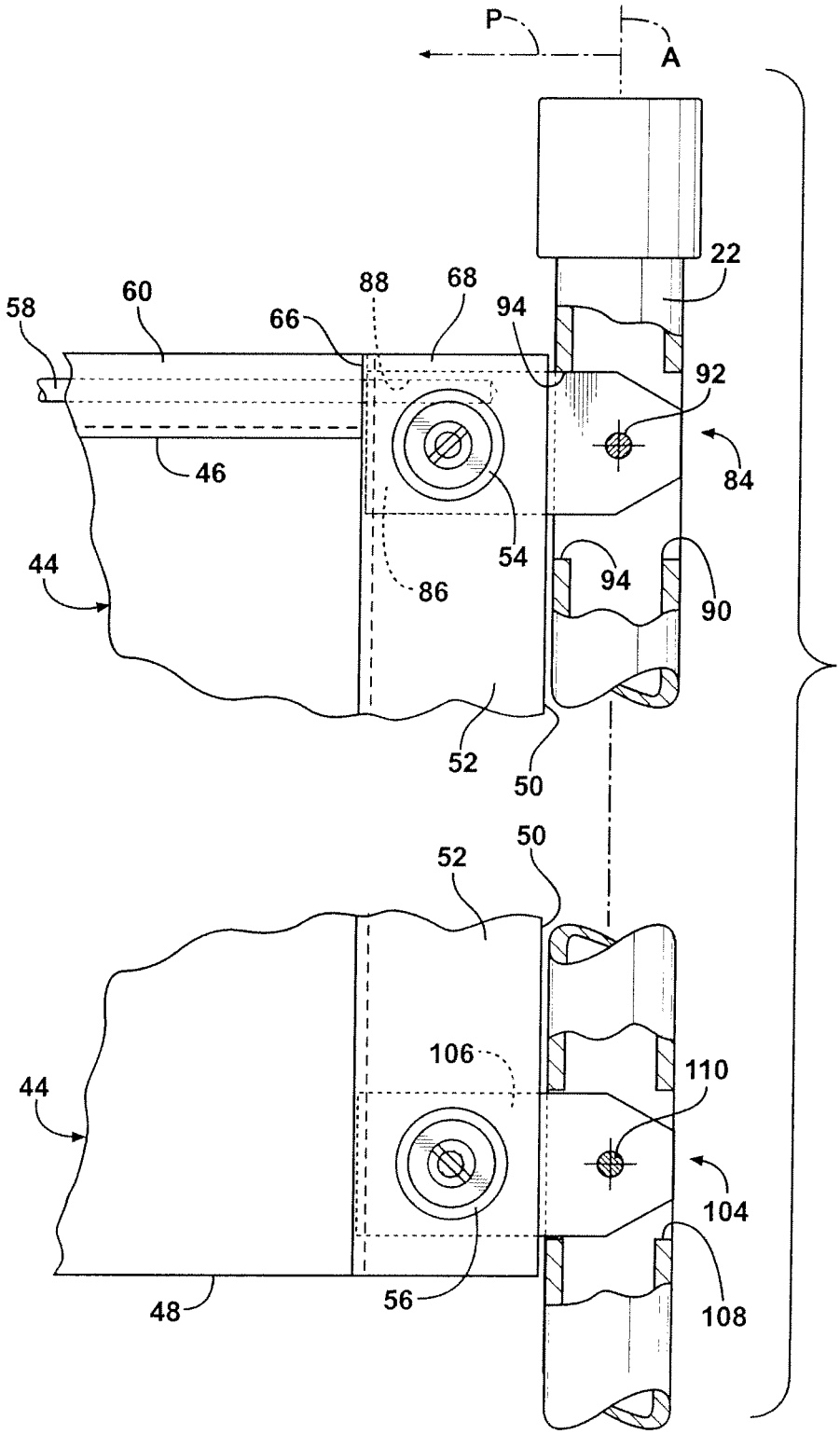
FIG. 10 is a fragmentary side view of the wrap preventing flag apparatus displaying an alternative design of the rod support and connector according to the first embodiment.

In the first embodiment, the connector 104 includes a middle elongated slot 108 bisected by the gravity plane P and defined by the flagpole 20 medially between the upper portion 22 and the lower portion 24 of the flagpole 20. The connector 104 also includes a pin 110 extending from and supported in the middle elongated slot 108 of the flagpole 20 for retaining the connector 104 to the flagpole 20. An alternative design of the shape of the rod support 84 and connector 104 according to the first embodiment is shown in FIG. 10.

In the second or retrofit embodiment, a second bracket 112 is disposed about an existing flagpole 20 with the connector flange 106 for securing the connector 104 to the flagpole 20 in a fixed position. The second bracket 112 is fastened to the flagpole 20 by a threaded bore 98 receiving a tightening bolt 100. Alternatively, the second bracket 112 could be fastened to the flagpole 20 by a threaded nut secured to the second bracket 112 for receiving a threaded screw.

In both embodiments, an upper flag fastener 114, generally indicated, extends through the rod coupler 86 and into the top end grommet 54 and retains the flag 44 to the flagpole 20 to prevent the top end grommet 54 from moving axially along the pole axis A. A lower flag fastener 116, generally indicated, extends through the connector flange 106 and into the bottom end grommet 56 to prevent the bottom end grommet 56 from moving axially along the pole axis A. The fasteners 114, 116 could include bolts and may be secured with nuts and washers.

The subject invention also includes a method of fabricating a wrap preventing flag 44 apparatus comprising the steps of interconnecting the rod 58 and the upper portion 22 of the flagpole 20 to prevent the rod 58 from rotating about the pole axis A and to allow free rotation of the rod 58 under the force of gravity only in the gravity plane P, limiting rotation of the rod 58 in the gravity plane P between perpendicular to the pole axis A and thirty degrees a from the perpendicular toward the lower portion 24 of the flagpole 20.

The fabrication continues by rotatably supporting a rod coupler 86 on the flagpole 20 to allow rotation of the rod 58 only in the gravity plane P and adhesively securing the rod 58 in the bore 88 disposed in the rod coupler 86. This leads to securing the flag 44 to the rod 58, either by inserting the rod 58 into a sleeve 60 extending along the top edge 46 of the flag 44 to the distal end 64 of the flag 44, or by attaching clamps 62 disposed about the rod 58 and the top edge 46 of the flag 44, fastening a top end grommet 54 to the rod coupler 86, supporting a connector 104 on the flagpole 20, and fastening a bottom end grommet 56 to a connector flange 106 extending from the connector 104.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. An apparatus for preventing a flag (44) from wrapping wherein the flag includes a top edge (46) and a bottom edge (48) and a heading (52) extending therebetween with a top end grommet (54) and a bottom end grommet (56) in the heading (52), said apparatus comprising:

an elongated pole (20) extending along a pole axis (A) and having a lower portion (24) for mounting said pole (20) and an upper portion (22) bisected by a gravity plane (P) extending radially from said pole axis (A), a rod (58) of non-rigid material extending from said upper portion (22) of said pole (20) in said gravity plane (P) for extending into a sleeve (60) of the flag (44), a rod support (84) interconnecting said rod (58) and said upper portion (22) of said pole (20) preventing said rod (58) from rotating about said pole axis (A) and allowing free rotation of said rod (58) about an axis under the force of gravity only in said gravity plane (P), said rod support (84) defining an upper elongated slot (90) extending into said upper portion (22) of said pole (20) and bisected by said gravity plane (P), said rod support (84) including a rod coupler (86) extending from within said upper elongated slot (90) in said pole (20) and defining a bore (88) therein in said gravity plane (P) receiving said rod (58) and for connection to the top end grommet (54) to retain the flag (44) to said pole (20), said rod support (84) further including a shaft (92) supported by said pole (20) in said upper elongated slot (90) and extending through said pole (20) and through said rod coupler (86) within said upper elongated slot (90) for rotatably supporting and limiting said rotation of said rod coupler (86) to only in said gravity plane (P), a middle elongated slot (108) bisected by said gravity plane (P) and extending into said pole (20) and spaced between said upper portion (22) and said lower portion (24) of said pole (20), a connector (104) extending radially from within said pole (20) in said middle elongated slot (108) for connection to the bottom end grommet (56) of the flag (44) to retain the flag (44) to said connector (104) and to said pole (20), and a pin (110) supported in said middle elongated slot (108) and extending through said pole (20) and through said connector (104) for retaining said connector (104) to said pole (20).

2. An apparatus as set forth in claim 1 including a flag (44) rectangular in shape to define a top edge (46) and a bottom edge (48) and a heading edge (50), the sleeve (60) extending along said top edge (46) of said flag (44) for enclosing said rod (58).

3. An apparatus as set forth in claim 2 including a heading (52) extending along said a heading edge (50) of said flag (44), the top end grommet (54) disposed in said heading (52) adjacent to said top edge (46) and the bottom end grommet (56) disposed in said heading (52) adjacent to said bottom edge (48), and an upper flag fastener (114) extending through said rod coupler (86) and into said top end grommet (54) for retaining said flag (44) to said pole (20) to prevent said top end grommet (54) from moving axially along said pole axis (A), and a lower flag fastener (116) extending through said connector (104) and into said bottom end grommet (56) for retaining said flag (44) to said pole (20) to prevent said bottom end grommet (56) from moving axially along said pole axis (A).

4. An apparatus as set forth in claim 1 including a pole support (26) including a base (28) and a tube (30) extending from said base (28) at an angle of forty-five degrees for receiving said lower portion (24) of said pole (20) and a pole retainer (36) for retaining said pole (20) in said pole support (26).

5. A wrap preventing apparatus comprising:

an elongated pole (20) extending along a pole axis (A) and having an upper portion (22) and a lower portion (24) bisected by a gravity plane (P) extending radially from and along said pole axis (A), said lower portion (24) of said pole (20) including a lower portion end (34) angled at forty-five degrees, a pole support (26) including a base (28) and a tube (30) extending from said base (28) at an angle of forty-five degrees for receiving said lower portion (24) of said pole (20) and for retaining said pole (20) in said pole support (26), a pole retainer (36) defining a hole (38) in said lower portion (24) of said pole (20) bisected by said gravity plane (P) from said pole axis (A), said pole retainer (36) including a nut (40) secured to said tube (30) and aligned with said hole (38), said pole retainer (36) including a threaded bolt (42) threadedly engaging said nut (40) and extending through said tube (30) of said pole support (26) and into said hole (38) in said lower portion (24) of said pole (20) for retaining said pole (20) in said pole support (26) and for preventing rotation of said pole (20) about said pole axis (A) within said pole support (26), flag (44) rectangular in shape to define a top edge (46) and a bottom edge (48) and a heading edge (50), a rod (58) extending from said upper portion (22) of said pole (20) in said gravity plane (P), at least one attachment (60, 62) for attaching said top edge (46) of said flag (44) to said rod (58), said rod (58) formed from non-rigid material having a circular cross-section, said flag (44) having a heading (52) extending along said heading edge (50) of said flag (44), said flag (44) including a top end grommet (54) disposed in said heading (52) adjacent to said top edge (46) and a bottom end grommet (56) disposed in said heading (52) adjacent to said bottom edge (48), and characterized by, a rod support (84) interconnecting said rod (58) and said upper portion (22) of said pole (20) preventing said rod (58) from rotating about said pole axis (A) and allowing free rotation of said rod (58) about an axis under the force of gravity only in said gravity plane (P), said rod support (84) including a rod coupler (86) extending radially from said pole (20) and defining a bore (88) therein in said gravity plane (P) receiving said rod (58), said rod support (84) including an upper elongated slot (90) extending into said upper portion (22) of said pole (20) and bisected by said gravity plane (P), said rod support (84) including a shaft (92) supported by said pole (20) and extending through said upper elongated slot (90) and rotatably supporting said rod coupler (86) within said upper elongated slot (90) for allowing free rotation of said rod support (84) about an axis under the force of gravity only in said gravity plane (P), an adhesive securing said rod (58) in said bore (88) of said rod coupler (86), an upper flag fastener (114) extending through said rod coupler (86) and into said top end grommet (54) for retaining said flag (44) to said pole (20) to prevent said top end grommet (54) from moving axially along said pole axis (A), a middle elongated slot (108) bisected by said gravity plane (P) and extending into said pole (20) and spaced between said upper portion (22) and said lower portion (24) of said pole (20), a connector (104) supported by and extending from said middle elongated slot (108) within said pole (20) and fixed medially between said upper portion (22) and said lower portion (24) of said pole (20) for retaining said flag (44) to said pole (20) and including a connector flange (106) extending radially from said connector (104) for retaining said flag (44) to said connector (104), a pin (110) supported in said middle elongated slot (108) and extending through said pole (20) and through said connector (104) for retaining said connector (104) to said pole (20), a lower flag fastener (116) extending through said connector flange (106) and into said bottom end grommet (56) to prevent said bottom end grommet (56) from moving axially along said pole axis (A), said rod support (84) including a pair of stops (94) in said pole (20) for limiting rotation of said rod (58) in said gravity plane (P) between perpendicular to said pole axis (A) and thirty degrees (A) from said perpendicular toward said lower portion (24) of the pole (20) for preventing slack in said flag (44), said rod coupler (86) engaging said upper elongated slot (90) in said pole (20) to establish said pair of stops (94), said attachment (60, 62) including a sleeve (60) extending along said top edge (46) of said flag (44) to a distal end (64) of said top edge (46), said rod (58) extending from said upper portion (22) of said pole (20) in said gravity plane (P) and into said sleeve (60), and said sleeve (60) being closed at said distal end (64) and including reinforced stitching for engaging said rod (58) and for preventing said flag (44) from sliding along said rod (58) toward said pole (20).

* * * * *